US006452340B1

(12) United States Patent
Morrissey, Jr. et al.

(10) Patent No.: US 6,452,340 B1
(45) Date of Patent: Sep. 17, 2002

(54) LUMINAIRE STARTING AID DEVICE

(75) Inventors: Joseph F. Morrissey, Jr., Rockland; Jeff Walters, Marshfield, both of MA (US)

(73) Assignee: Acuity Brands, Inc., Atlanta, GA (US)

( * ) Notice: Subject to any disclaimer, the term of this patent is extended or adjusted under 35 U.S.C. 154(b) by 0 days.

(21) Appl. No.: 09/544,307

(22) Filed: Apr. 6, 2000

Related U.S. Application Data

(60) Provisional application No. 60/128,635, filed on Apr. 9, 1999.

(51) Int. Cl.[7] ..... H05B 37/02

(52) U.S. Cl. ..... 315/151; 315/209 R; 315/119; 315/DIG. 7

(58) Field of Search ..... 315/DIG. 7, 119, 315/151, 209 R, 212, 291, 224, 307, 150, 308, 129

(56) References Cited

U.S. PATENT DOCUMENTS 4,396,872 A * 8/1983 Nutter ..... 315/308
4,473,779 A * 9/1984 Lindner et al. ..... 315/119
5,095,502 A * 3/1992 Finzel ..... 340/331
5,223,795 A * 6/1993 Blades ..... 324/536
5,397,963 A * 3/1995 Manson ..... 315/119
5,463,287 A 10/1995 Kunhara et al. ..... 315/308
5,569,984 A * 10/1996 Holtslag ..... 315/307
5,677,602 A * 10/1997 Paul et al. ..... 315/224
5,801,494 A * 9/1998 Herres et al. ..... 315/289
5,821,700 A * 10/1998 Malvaso ..... 315/291
6,028,396 A * 2/2000 Morrissey, Jr. et al. ..... 315/119
6,119,076 A * 9/2000 Williams et al. ..... 702/108

FOREIGN PATENT DOCUMENTS

CA 1 205 853 6/1986 ..... 315/73

* cited by examiner

*Primary Examiner*—Don Wong
*Assistant Examiner*—Ephrem Alemu
(74) *Attorney, Agent, or Firm*—Geoff L. Sutcliffe, Esq.; John S. Pratt, Esq.; Kilpatrick Stockton LLP

(57) ABSTRACT

A starting aid for a luminaires includes a trigger circuit for supplying a trigger voltage pulse to a lamp in response to the presence of a line voltage signal supplied by a photodetector, a feedback circuit for detecting the lamp voltage and means, responsive to the line voltage signal and the feedback circuit, for comparing the voltage on the lamp to a nominal voltage level for disabling the trigger circuit and terminating the trigger voltage pulse in the presence of a lamp cycling or lamp out condition.

47 Claims, 11 Drawing Sheets

LUMINAIRE STARTING AID DEVICE

RELATED APPLICATIONS

This application claims the benefit of U.S. Provisional Patent Application No. 60/128,635, filed Apr. 9, 1999.

FIELD OF INVENTION

This invention relates to luminaries such as street lamps, and more particularly to a starting aid device for a luminaire which automatically turns the luminaire on and off, can sense a faulty condition and can communicate that condition locally or to a remote location.

BACKGROUND OF INVENTION

Servicing a luminaire such as a single street light can cost $100 or more on busy roads, and in busy areas. Moreover, since there are 60,000,000 street lights in the United States alone, the cost of servicing high pressure sodium (HPS) street lights cycling towards the end of their useful life is severe. The phenomena of cycling of HPS lamps as they age from use is the result of the electrode material being plated off the electrodes and then being deposited on the inside of the arc tube. This makes the tube darken and traps more heat inside the arc tube. As a result, an increased voltage is required to keep the lamp ignited or ionized. When the voltage limit of the ballast is reached, the lamp extinguishes by ceasing to ionize. The lamp must then cool down for several minutes before an attempt at re-ignition can be made. The result is "cycling", in which the worn out lamp keeps trying to stay lighted. The voltage limit is reached again, the lamp extinguishes, and then after an approximately one-two minute cool down period, the arc tube re-ignites and the light output increases again and until the voltage limit is reached whereupon the lamp extinguishes yet again. This repetitive on and off process is called cycling.

Cycling can waste electricity, cause radio frequency interference (RFI) which adversely affects communication circuits, radios, and televisions in the area, and may adversely effect and prematurely wear out the ballast, starter, and photocontroller.

For example, if an HPS lamp undergoes cycling for a few nights before it is finally serviced and replaced, the ballast or starter can also be damaged or degraded. However, when the HPS lamp is replaced, such damage or degradation might not be detected. Consequently, additional service calls must then be made to service these problems. The ballast and starter components are more expensive than the lamp or the photocontroller.

The cycling problem is well documented, but so far the only solutions offered are to replace the HPS lamps and luminaires with less efficient mercury lamps and luminaires or to reconfigure the photocontroller with a special fiber optic sensor which senses light from the lamp and sends a signal to a microprocessor to indicate whether the lamp is on or off. After three on/off cycles, the microprocessor turns the lamp off and turns on a red strobe light which can be seen from the street. Unfortunately, this prior art solution requires modifications to the existing light fixture (e.g. a hole must be drilled in the fixture housing) and the use of an expensive fiber optic sensor.

Another problem with all luminaries including HPS or other types of lamps is the cost involved in correcting the cycling problem and other faults such as a lamp out condition. For example, a resident reports a lamp out or a cycling condition. However, by the time the repair personnel arrives several hours later, the lamp may have cycled back on. Considering the fact that the lamp pole may be 25–35 ft. high, repair personnel can waste a considerable amount of time checking each lamp in the area. Also, repair and maintenance personnel may not be able to service a given residential area until daylight hours when all of the street lights are off by design.

BRIEF SUMMARY OF THE INVENTION

It is therefore an object of this invention to provide a starting aid circuit for a lamp which can detect a faulty condition.

It is a further object of this invention to provide such a starting aid circuit which is microprocessor-based.

It is a further object of this invention to provide such a starting aid circuit which prevents hot restriking of a cycling or a dead lamp.

It is a further object of this invention to provide such a starting aid circuit which communicates that a fault in the lamp has occurred.

It is a further object of this invention to provide such a starting aid circuit which can communicate such a condition to a worker on the ground.

It is a further object of this invention to provide such a starting aid circuit which can communicate a faulty condition to a remote location.

It is a further object of this invention to provide such a starting aid circuit which automatically turns on and off in response to daytime and nighttime lighting conditions.

It is a further object of this invention to provide such a starting aid circuit which also turns the lamp off.

It is a further object of this invention to provide such a starting aid circuit which can detect whether the lamp is on or off.

It is a further object of this invention to provide such a starting aid circuit which can detect cycling of the lamp.

It is a further object of this invention to provide such a starting aid circuit which reduces maintenance of the lamp.

It is a further object of this invention to provide such a starting aid circuit which prolongs the life of the lamp.

It is a further object of this invention to provide such a starting aid circuit which is cost efficient to produce.

The invention results from the realization that a truly effective luminaire starting aid device can be obtained by providing a trigger circuit including a feedback loop that supplies a trigger voltage to the lamp and monitors the voltage of the lamp to determine if it has indeed started. If the lamp does not start, a microprocessor that controls the trigger circuit instructs the trigger circuit to repeat attempts to start the lamp a predetermined number of times, after which, if the lamp does not start, a faulty condition of the lamp is communicated either locally at the site of the luminaire or to a remote location.

This invention features a starting aid for a luminaire including a device for detecting a load drawn by or voltage across a lamp, a microprocessor, responsive to the means for detecting, for controlling start-up of the lamp, a power supply for operating the microprocessor and a trigger circuit, responsive to the microprocessor, for turning on the lamp.

In a preferred embodiment of the invention, the starting aid circuit may further be programmed to detect a condition of the lamp in response to the load drawn or voltage across the lamp. The starting aid circuit may further include means, responsive to the microprocessor, for indicating the occurrence of the condition detected. The starting aid circuit may further include a photo controller for automatically turning the lamp on during periods of darkness and off during periods of daylight and means, responsive to the microprocessor, for shunting the lamp to turn off the lamp. The means for detecting may include a voltage divider. The trigger circuit may include a SIDAC circuit for turning on the lamp and a relay circuit, responsive to the microprocessor, for enabling the SIDAC circuit. the trigger circuit may further include an opto-coupler, responsive to the microprocessor, for enabling the SIDAC circuit. The power supply may include a full wave rectifier and/or a half wave rectifier. The trigger circuit may further include a TRIAC circuit, responsive to the microprocessor, for enabling the SIDAC circuit. The starting aid circuit may further include means, responsive to the microprocessor, for shunting the lamp to turn off the lamp. The means for shunting may include a relay circuit, responsive to the microprocessor, for shorting the lamp. The means for shunting may include a TRIAC circuit or another silicon device such as a SCR circuit, responsive to the microprocessor, for shorting the lamp. The means for indicating may include a visual alarm, an audible alarm and/or a transmitter for transmitting the detected condition to a location. The condition may be a lamp dead condition and/or a cycling condition.

This invention also features a diagnostic starting aid for a luminaire including means for detecting a load drawn by or voltage across the lamp, a microprocessor, responsive to the means for detecting and the photocontroller, for controlling start-up of the lamp, the microprocessor programmed to detect a condition of the luminaire in response to the load drawn, a power supply for operating the microprocessor, a trigger circuit, responsive to the microprocessor, for turning on the lamp and means, response to the microprocessor, for indicating the occurrence of the condition detected.

This invention also features an automatic aid for a lamp including a photocontroller for automatically turning the lamp on during periods of darkness and off during periods of daylight, means for detecting a load drawn by or voltage across the lamp, a microprocessor, responsive to the means for detecting and to the photocontroller, for controlling start-up of the lamp, a power supply for operating the microprocessor and a trigger circuit, responsive to the microprocessor, for turning on the lamp.

In the preferred embodiment, the automatic starting aid may further include means, responsive to the microprocessor, for shunting the lamp to turn off the lamp. The microprocessor may be programmed to detect a condition of the lamp in response to the load drawn, further including means, responsive to the microprocessor, for indicating the occurrence of the condition detected.

This invention also features a starting aid including a trigger circuit for supplying a trigger voltage pulse to a lamp in response to the presence of a line voltage signal supplied by a photodetector, a feedback circuit for detecting the lamp voltage and means, responsive to the line voltage signal and the feedback circuit, for comparing the voltage on the lamp to a nominal voltage level for disabling the trigger circuit and terminating the trigger voltage pulse in the presence of a lamp cycling or lamp out condition.

In the preferred embodiment, the means for comparing may include a processor programmed to determine when the lamp voltage switches between a nominal voltage level and a non-nominal voltage level N times indicative of a lamp cycling condition. N may be 5. The means for comparing may include a processor programmed to determine when the voltage on the lamp falls to reach a nominal voltage level after M trigger voltage pulses. M may be 2. The starting aid may further include means, responsive to the line voltage signal, for supplying to the trigger circuit a series of trigger pulses at predetermined portions of the line voltage signal. The means for supplying may include a microprocessor programmed to determine a zero crossing point of the line voltage signal and to output the series of pulses when the line voltage signal reaches 90° and 270°. The trigger circuit may include a transformer which is activated by the series of trigger pulses and in response produces a lamp starting voltage to the lamp.

BRIEF DESCRIPTION OF THE DRAWINGS

Other objects, features and advantages will occur to those skilled in the art from the following description of a preferred embodiment and the accompanying drawings, in which.

DESCRIPTION OF THE PREFERRED EMBODIMENT

Figure 1:
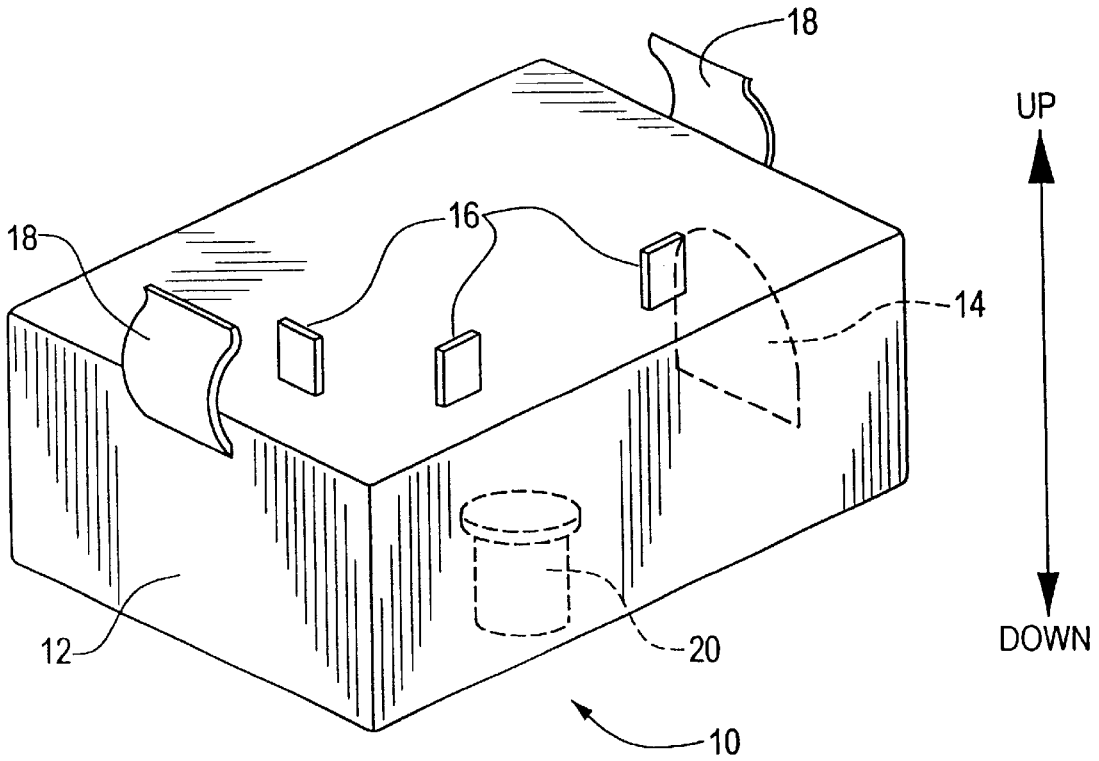
FIG. 1 is a three dimensional view of the starting aid for a lamp according to the present invention.

Luminaire starting aid 10, FIG. 1, includes thermoplastic, impact resistant, ultra violet stabilized polypropylene cover 12 and clear window 14 made from UV stabilized, UV absorbing acrylic for the light sensor, not shown, which resides on a circuit board within cover 12. Luminaire starting aid 10 is typically configured to fit an existing luminaire receptacle. Prongs 16 plug into a luminaire assembly and retaining clips 18 hold device 10 in place: the device according to the present invention is mounted underneath the luminaire such that alarm LED 20 can be viewed by a worker from the ground to determine if a fault exists without having to be raised up to the lamp assembly.

Figure 2:
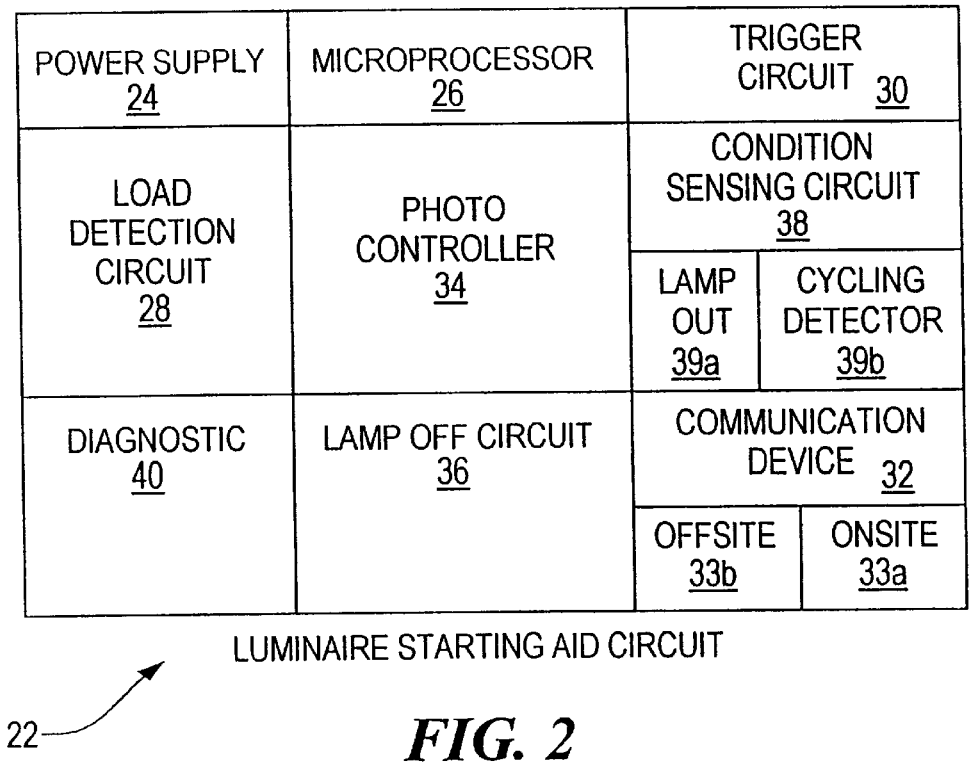
FIG. 2 is a block diagram of the starting aid circuit according to the present invention.

Luminaire starting circuit 22, shown in block form in FIG. 2, generally includes power supply 24, microprocessor 26, load detection circuit 28, trigger circuit 30 and communication device 32, which may include both on site and offsite portion 33*a* and 33*b*, respectively. Starting circuit 22 may optionally include a photocontroller 34, a lamp off circuit 36, a condition sensing circuit 38 including lampout device 39*a* and cycling detector 39*b* and diagnostic circuitry 40.

Figure 3:
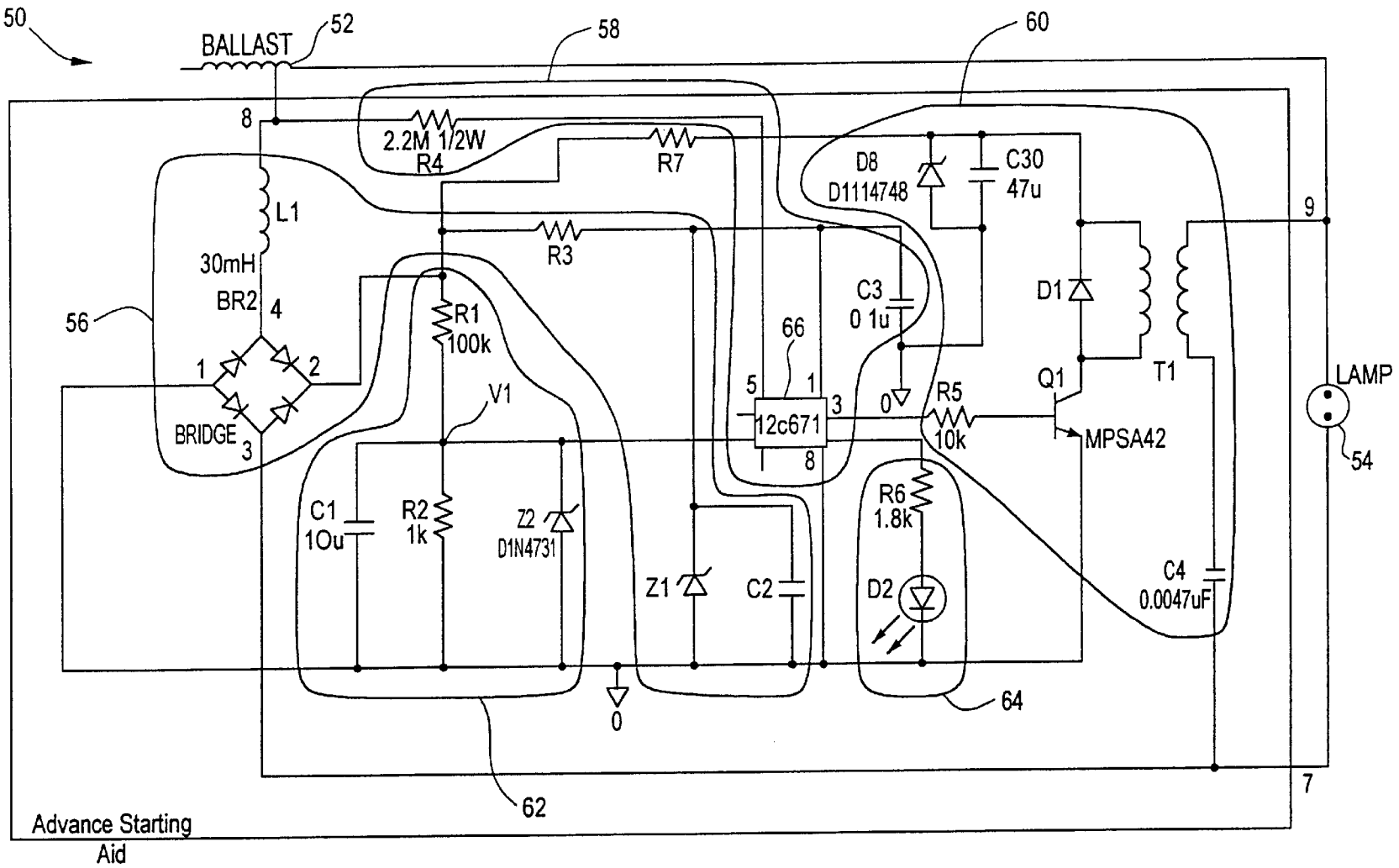
FIG. 3 is a schematic diagram of a first embodiment the starting aid according to the present invention.

The basic operation of starting aid circuit 50, FIG. 3, is such that power supply 56, which includes inductor L1, diode bridge BR2, resistor R3, capacitor C2 and Zener diode Z1, delivers the necessary voltage needed for each of the sub circuits. Bridge BR2 (which could also be four individual diodes), R3, Z1 and C2 make up a 5 volt power supply. Inductor L1 is used to increase the impedance at high frequency of starting aid circuit 50. Bridge BR2 rectifies the AC voltage coming from the tap of ballast 52. However, it should be noted that the voltage to drive starting aid circuit 50 could also come from the lamp side of ballast 52. Resistor R3 is a current limiting resistor. The value of resistor R3 is such that it will limit the current so that microprocessor circuit 58, alarm LED 64, and trigger circuit 60 will receive sufficient current in order to operate normally. Zener diode Z1 regulates the voltage to microprocessor circuit 58 and trigger circuit 60. Capacitor C2 is used to filter any AC ripple which may be present on the 5-volt line and further provides peak pulse current to trigger circuit 60 and alarm LED circuit 64. Initially microprocessor 66 of microprocessor circuit 58 will wait a predetermined period of time, for example one second, before carrying out any instructions. This allows capacitor C1 of voltage divider 62 to charge up. Thereafter, the main loop of the program is started.

Voltage divider 62 is provided in order to detect a load drawn by lamp 54. Resistors R1 and R2 make up a 100:1 voltage divider. The rectified voltage is thus delivered to microprocessor 66 as a sample voltage, proportional to the voltage across lamp 54. Microprocessor 66 uses this voltage to determine the status of lamp 54. Capacitor C1 further filters the sample voltage being used by microprocessor 66. Zener diode Z2 ensures that the sample voltage does not damage the input circuit of microprocessor 66. A voltage reading is taken at node V1. When lamp 54 is off, the voltage detected at node V1 should be proportional to the line voltage, or the highest voltage the circuit will see. This voltage is then multiplied by 0.75 to determine the trip voltage. By choosing 75% of the highest voltage, the present circuit provides a universal starting aid that can be used in conjunction with 55 volt or 100 volt lamps without modification.

Microprocessor circuit 58 includes resistor R4, capacitor C3 and microprocessor 66 which may be for example, a 12C671 or a 12C672 available from Microchip of Arizona. Resistor R4 is a current limiting resistor which provides microprocessor 66 with a clock pulse derived from the line frequency. Capacitor C3 is a bypass capacitor for microprocessor 66. The 12C671 (or 12C672) microprocessor has analog to digital (A/D) capabilities. This allows the analog voltage sampling of the lamp voltage to be converted to a digital value so that microprocessor 66 can determine the status of the lamp, as described below.

In operation, microprocessor 66 sends out a pulse train to trigger circuit 60. Trigger circuit 60 includes resistor R5, transistor Q1, transformer T1, diodes D1 and D8 and capacitors C4 and C30. Resistor R5 is a current limiting resistor which is used to develop the base current to turn on transistor Q1. Transistor Q1 is driven on and off by microprocessor 66 in response to pulses sent by microprocessor 66. These pulses are coupled to lamp 54 by transformer T1. The primary winding of transformer T1 is connected between a regulated five (5) volts from power supply 56 and Q1. When transistor Q1 is pulsed on, the five (5) volts is stepped up to approximately 3500 volts. The pulse is typically 1.5$\mu$sec in duration and should be sufficient to start lamp 54. Capacitor C4 limits the leakage current that will flow through the secondary windings of transformer T1. Microprocessor 66 waits a predetermined period of time, for example two (2) seconds. A second voltage reading is taken at node V1. If the second voltage read at node V1 is lower than the trip voltage which, as discussed above, is taken as 75% of the line voltage, the lamp has started. However, if the second voltage reading at node V1 is not lower than the trip voltage, microprocessor 66 sends another pulse train to trigger circuit 60. In the preferred embodiment, this process is repeated four more times for a total of five times. If the voltage never drops below the trip voltage it is assumed that the lamp 54 is dead and the indicator circuit 64 is activated to notify a line worker that the lamp 54 is not working. Alarm circuit 64 includes resistor R6 and light emitting diode D2. Resistor R6 is current limiting resistor for LED D2. LED D2 will light in response to instructions from microprocessor 66 to indicate to a line worker that lamp 54 is dead. If, on the other hand, after lamp 54 starts it is then cycled off, microprocessor 66 will wait a predetermined period of time, for example two minutes, and then try to start the lamp 54 again. This is done to prevent hot restriking of lamp 54. If lamp 54 does start again and again cycles, microprocessor 66 monitors the number of times the cycling occurs and limits restarting of the lamp 54 to a maximum number, for example five (5) times, in a single night. If the lamp 54 cycles the predetermined number of times, the lamp 54 will be considered faulty and LED D2 of alarm circuit 64 will be activated.

Figure 10:
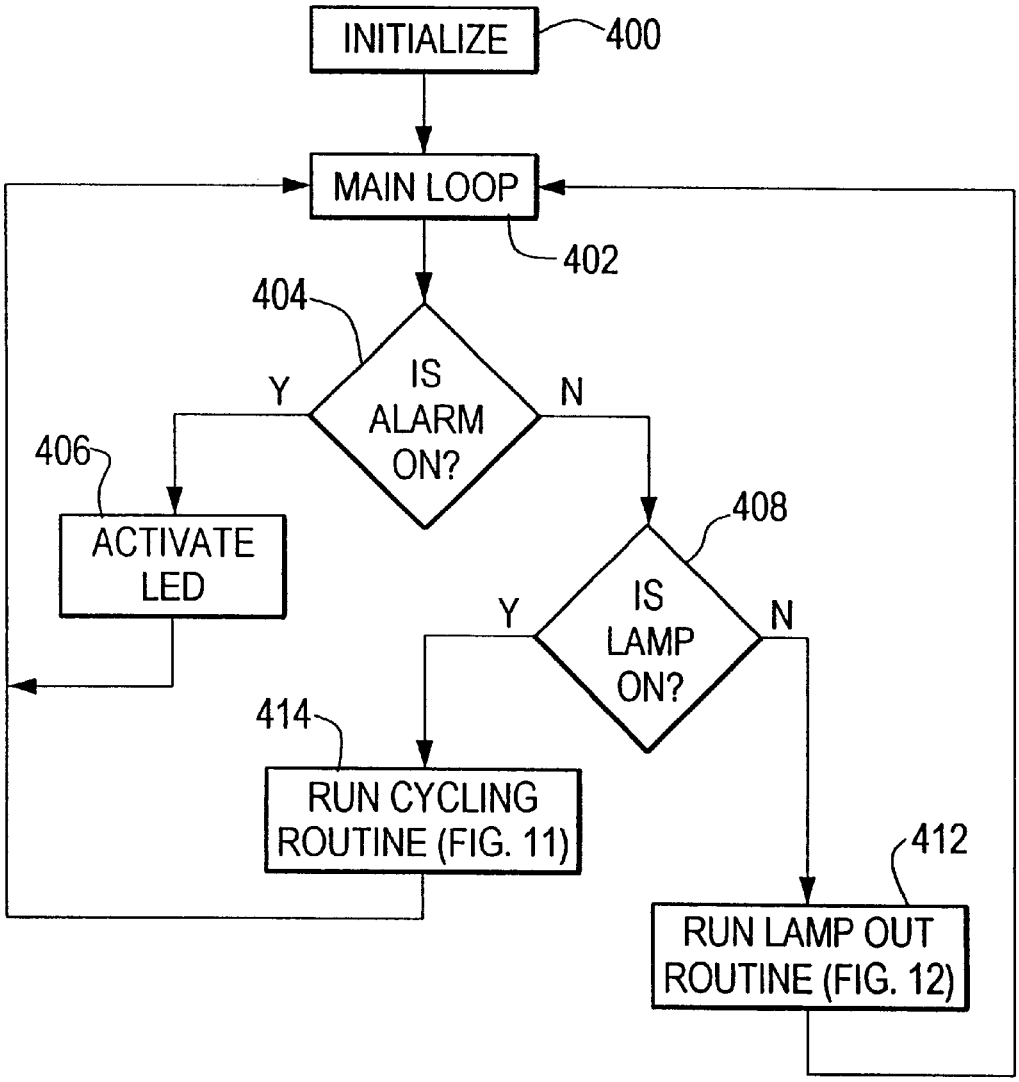
FIG. 10 is a flow chart generally showing the operation of the starting aid circuit according to the present invention.

The operation of the starting aid circuit 50 will now be described with reference to the flow charts of FIGS. 10–12. After the circuit is initialized, block 400, the system enters he main loop, block 402. If the microprocessor 66 determines that the alarm is on, block 404, the alarm LED is activated, block 406, and the system returns to the main loop 402. If the microprocessor 66 determines that the system is not in an alarm state, the system determines whether the lamp 54 is on, block 408. If it is not, the system enters the lamp out routine, block 412, which is shown in greater detail in FIG. 12.

Figure 11:
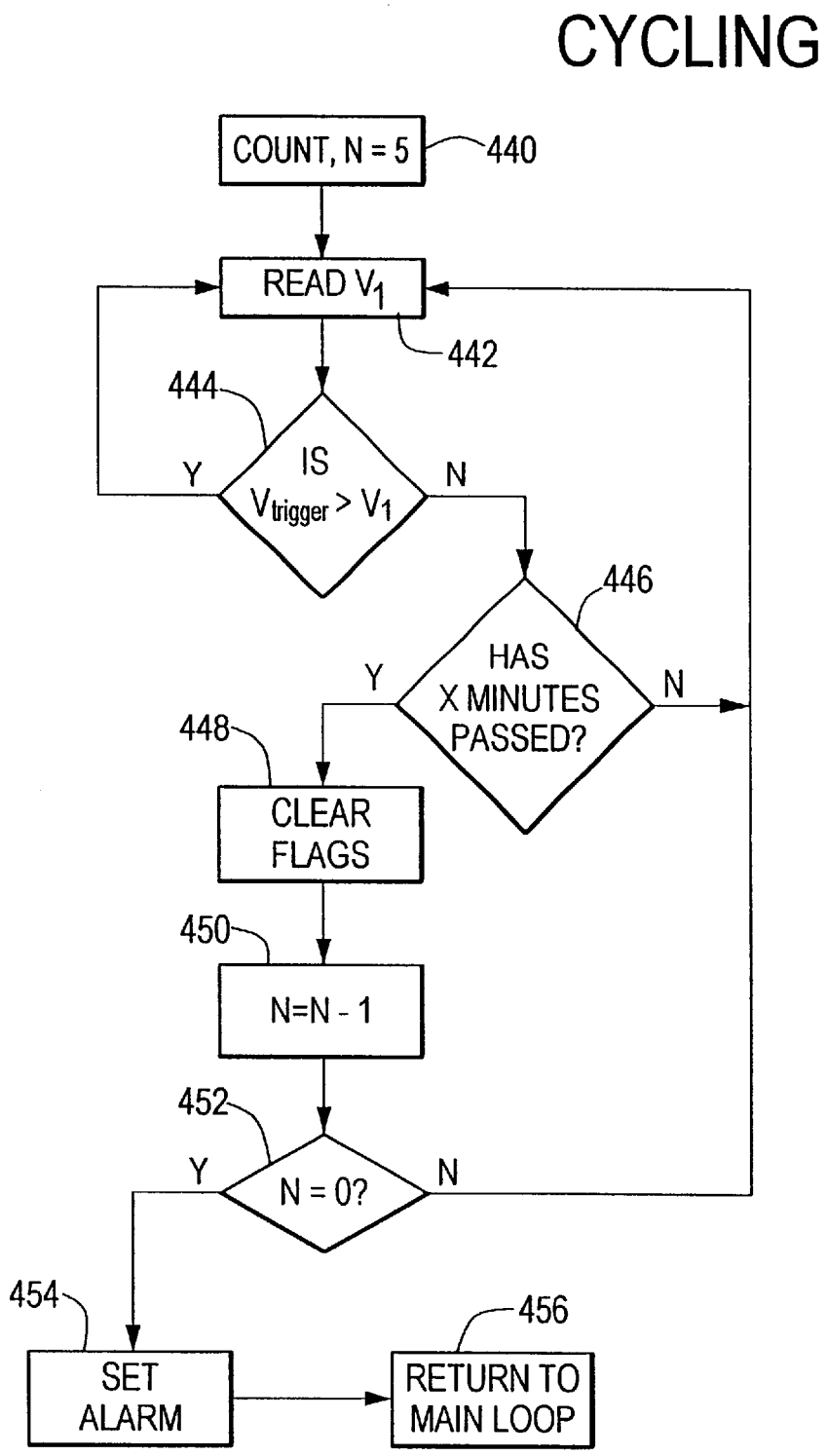
FIG. 11 is a flow chart depicting the routine for detecting a lamp out condition in accordance with the present invention.
Figure 12:
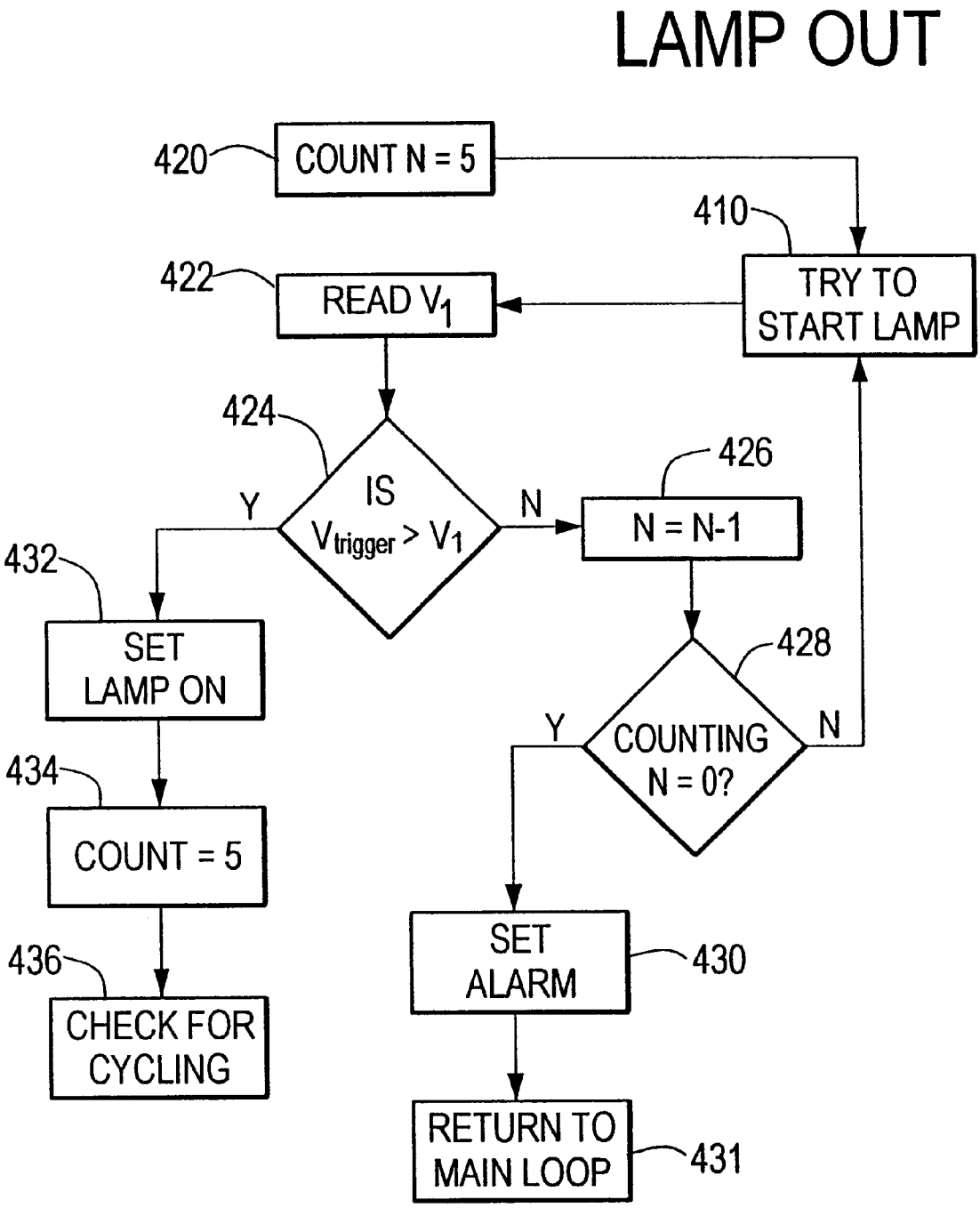
FIG. 12 is a flow chart depicting the routine for detecting a cycling condition of the lamp in accordance with the present invention.

As shown in FIG. 12, at block 420, a count N is set to 5 during initialization. A pulse is sent to the lamp in order to try and start the lamp, block 410 and then the voltage at node V1 is read, block 422. If the voltage at node 410 is not less than the trigger voltage, block 424, indicating the lamp has not been started, the count N is decremented by one, block 426. If the count N is not equal to 0, block 428, another pulse is sent to the lamp in order to attempt to start the lamp, block 410. Again, the voltage at node V1 is read, block 422 to determine if the lamp has been started. If, at block 428, the count N is equal to 0, indicating that the lamp has been attempted to be started five times, the alarm is set, block 430 and the system returns to the main loop, block 431. If, at block 424, the voltage at node V1 is less than the trigger voltage, a "lamp on" flag is set, block 432 and the count N is reset to 5, block 434. The system then checks if the lamp is cycling, block 436. Referring back to FIG. 10, since, at block 408, it is determined that the lamp is on, the cycling routine is run, block 414, as shown in FIG. 11.

In the cycling routine, FIG. 11, first the count N is set to 5 during initialization, block 440, and the voltage at node V1 is read, block 442. If the voltage at node V1 is less than the trigger voltage, block 444, the system determines that the lamp is indeed on and returns to block 442 to monitor the voltage at node V1. If in block 444, it is determined that the voltage at node V1 is not less than the trigger voltage, the system determines whether a predetermined period of time in minutes has passed, block 446. If it has not, the system returns to block 442 and continues to monitor the voltage at node V1. If the predetermined time period has passed, all flags are cleared, block 448, the count N is decremented by 1, block 450, and it is determined whether the count N is equal to 0, block 452. If it is not, the system returns to block 442 and continues monitoring the voltage at node V1. If, at block 452, the count N is equal to 0, the alarm is set, block 454, and the system returns to the main loop, block 456.

Figure 4:
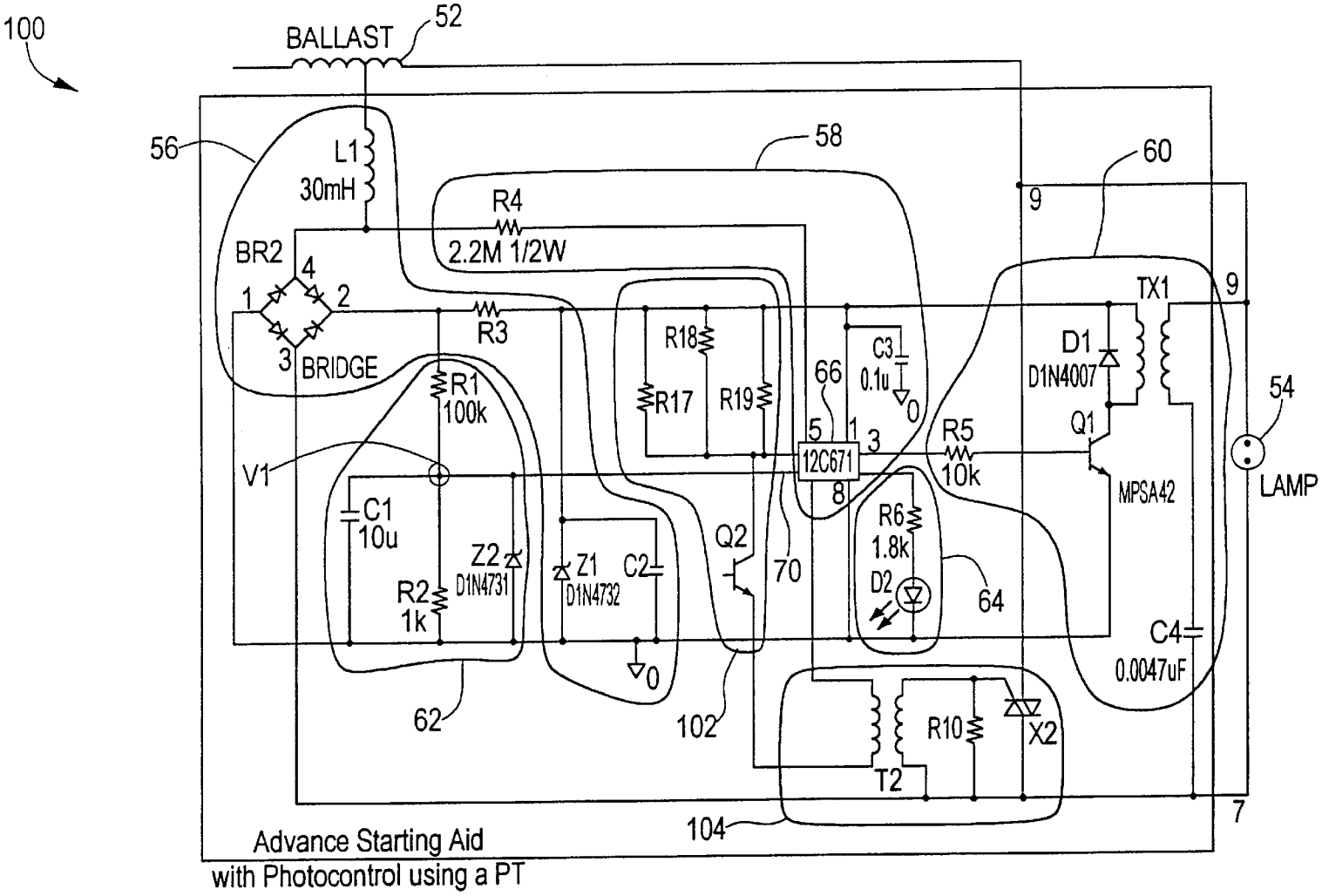
FIG. 4 is a schematic diagram, similar to FIG. 3, further including a photo controller for automatically turning the lamp on and off and a lamp off circuit for shunting the lamp to turn it off.

Another embodiment of the invention is shown at 100 in FIG. 4. Starting aid circuit 100 includes a photo control circuit 102 for turning lamp 54 on during nighttime hours and off during daytime hours. Photo control circuit 102 includes resistors R17, R18, and R19 and transistor Q2. Resistors R17, R18 and R19 are used as calibration resistors. These resistors may be snapped out of the circuit 100 to lower the calibration point to ensure that the microprocessor 66 turns the lamp 54 on at the correct light level. Transistor Q2 is a light sensing device, for example a phototransistor, that conducts proportionally to the light level it detects. This produces a voltage which is input to A/D pin 70 of microprocessor 66. This voltage reading is converted to a digital number and microprocessor 66 determines if lamp 54 is to be turned on, turned off, or maintained in its current state. If the lamp is to be turned on, pulses are sent to trigger circuit 60 as described above. If, however, lamp 54 is to be turned off, pulses are delivered to lamp off circuit 104. Lamp off circuit 104 includes transformer T2, resistor R10, and TRIAC X2. Lamp off circuit 104 turns lamp 54 off by placing a short across, or shunting the lamp. Transformer T2 is an isolation transformer and is needed since microprocessor 66 is not referenced to neutral as the lamp 54 is. Resistor R10 is a biasing resistor for TRIAC X2. A resistor or some other current limiting device may also be placed in line with TRIAC X2.

Figure 5:
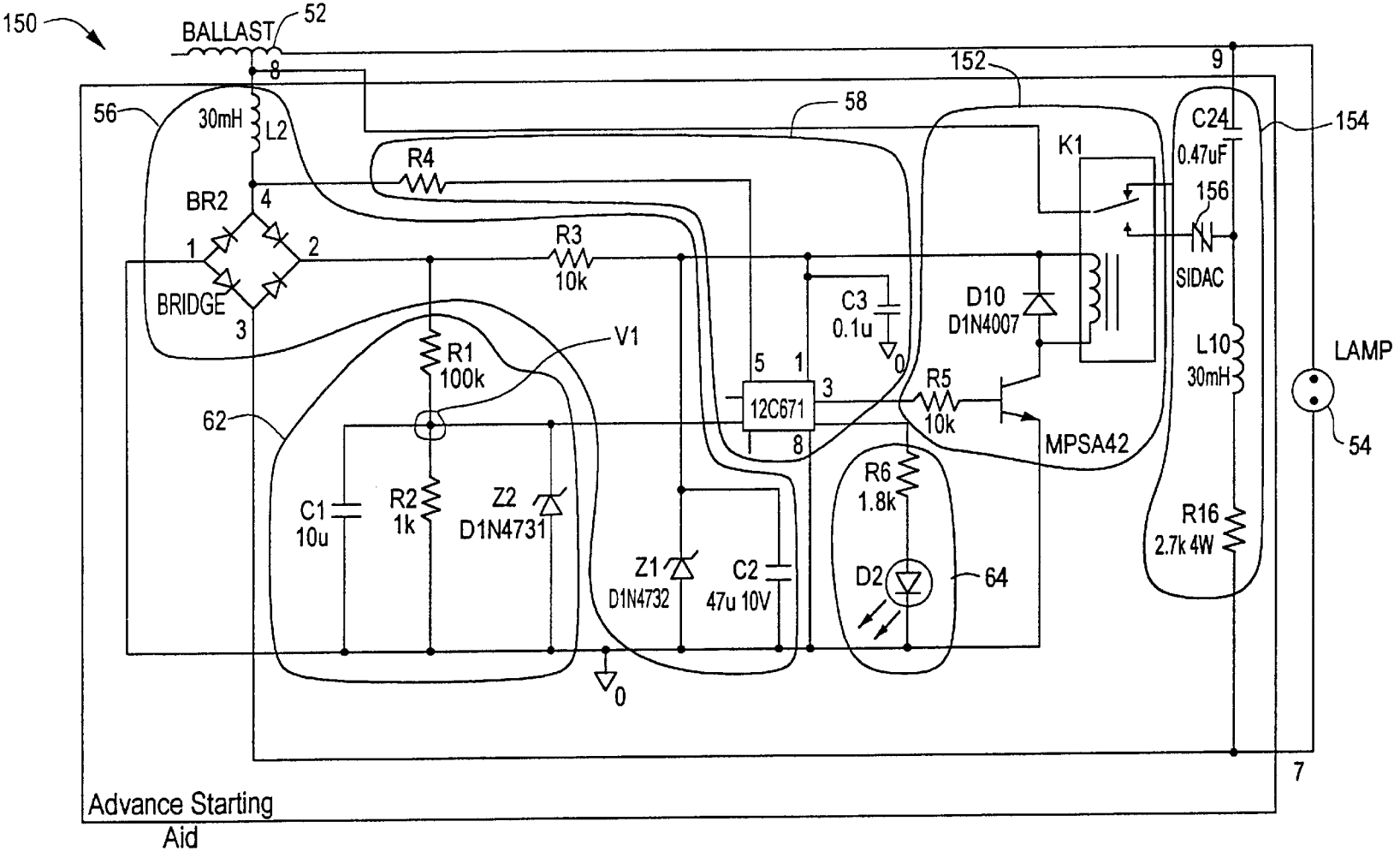
FIG. 5 is a schematic design of a third embodiment of the invention, in which the trigger circuit includes a SIDAC circuit for turning on the lamp and a relay circuit for enabling the SIDAC.

Another embodiment of the invention is shown at 150 in FIG. 5. Staring aid circuit 150, includes relay trigger circuit 152 which includes relay K1 to enable SIDAC trigger circuit 154. The primary difference between trigger circuit 154 and trigger circuit 60 is that, rather than a pulse train being sent by microprocessor 66, a single pulse of a duration of 2 seconds is used to energize relay K1. Resistor R5, transistor Q1, diode D1 and relay K1 are used to enable SIDAC circuit 154 which includes SIDAC 156, inductor L10, capacitor C24 and resistor R16. Resistor R5 is a current limiting resistor which develops the base current for transistor Q1 which energizes relay K1. Diode D10 operates as a back swing clipping diode intended to eliminate voltage spikes developed by relay K1 when the relay is de-energized.

When relay K1 is energized, SIDAC circuit 154 is enabled and lamp 54 will start. When relay K1 is de-energized, the lamp will not be triggered. This circuit 154 represents a traditional starting aid trigger circuit. The SIDAC 156 has high resistance until a specified voltage is reached, in which case it has low resistance. Indicator L1 is used to dampen the voltage spike that will be developed by C4, the ballast and the SIDAC. R6 is a current limit resistor.

When relay K1 is energized, SIDAC 156 will switch from a high resistance to low resistance. Capacitor C24 discharges through ballast 52 and a voltage spike is seen by lamp 54. This occurs every one-half cycle. When the voltage seen by SIDAC 156 drops below a specified voltage, SIDAC 156 returns to a high resistance state. When relay 156 is de-energized, there is no current path back to the SIDAC 156 and thus trigger circuit 154 is disabled.

Figure 6:
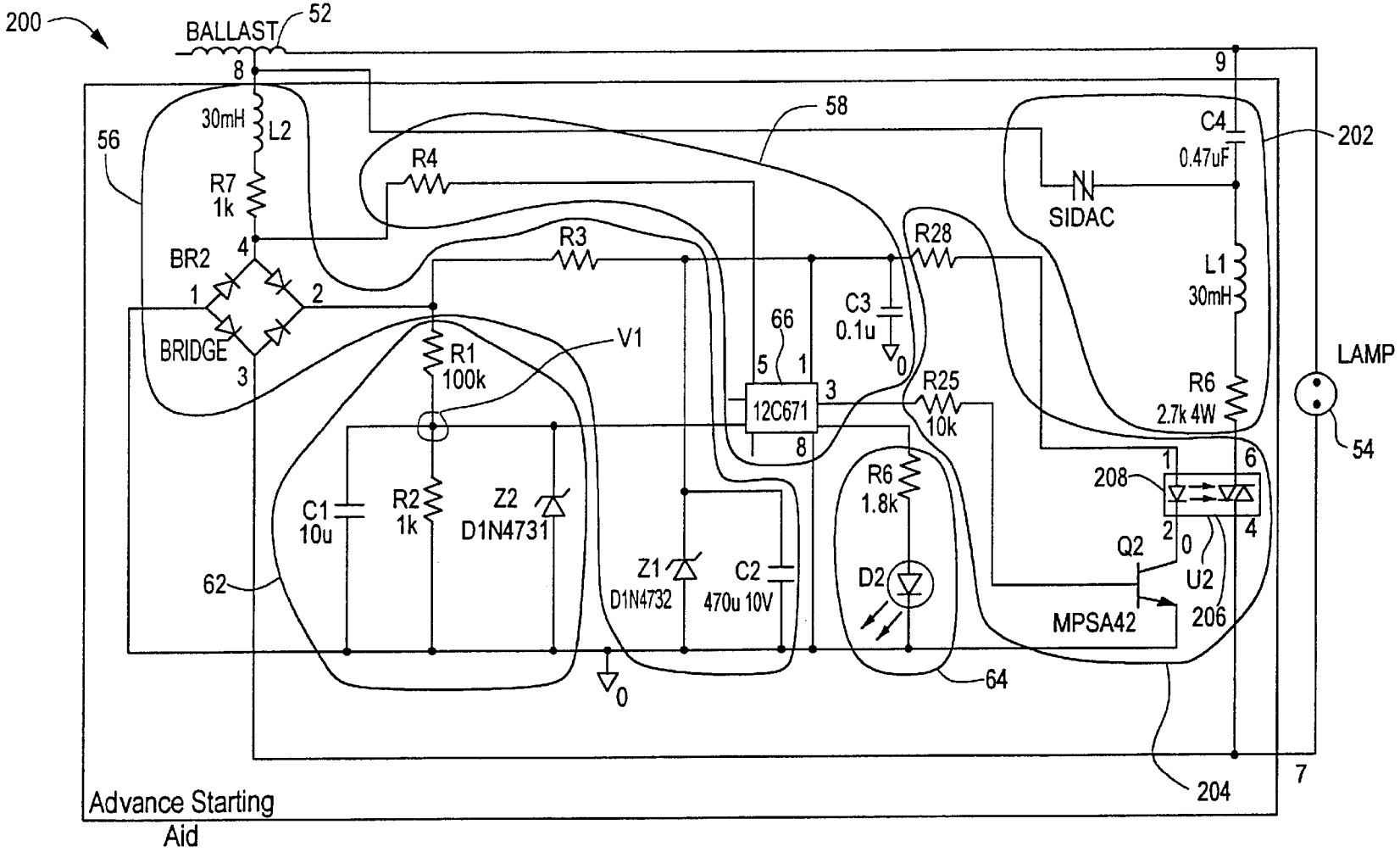
FIG. 6 is a schematic diagram of a third embodiment of the invention, in which the relay circuit is replaced by a photocoupler for enabling the SIDAC.

Another embodiment of the invention is shown at 200 in FIG. 6. Starting aid circuit 200, includes power supply 56 with the addition of resistor R7 which limits current and further helps prevent any transient voltage or current spikes from entering the rest of the circuit. Also included is opto-coupler circuit 204, which includes resistors R25 and R28, transistor Q2, and opto-coupler circuit 206, which provide a switch to turn on the circuit 202. Resistor R25 is a current limiting resistor that provides base current to transistor Q20. Transistor Q20 enables opto-coupler 206. Transistor Q20 is driven in response to microprocessor 66 to light LED 208 within opto-coupler 206. Resistor R28 limits the current to LED 208. The light produced by LED 208 causes opto-coupler 206 to conduct. When opto-coupler U2 is conducting, SIDAC circuit 202 is enabled, lighting lamp 54.

Figure 7:
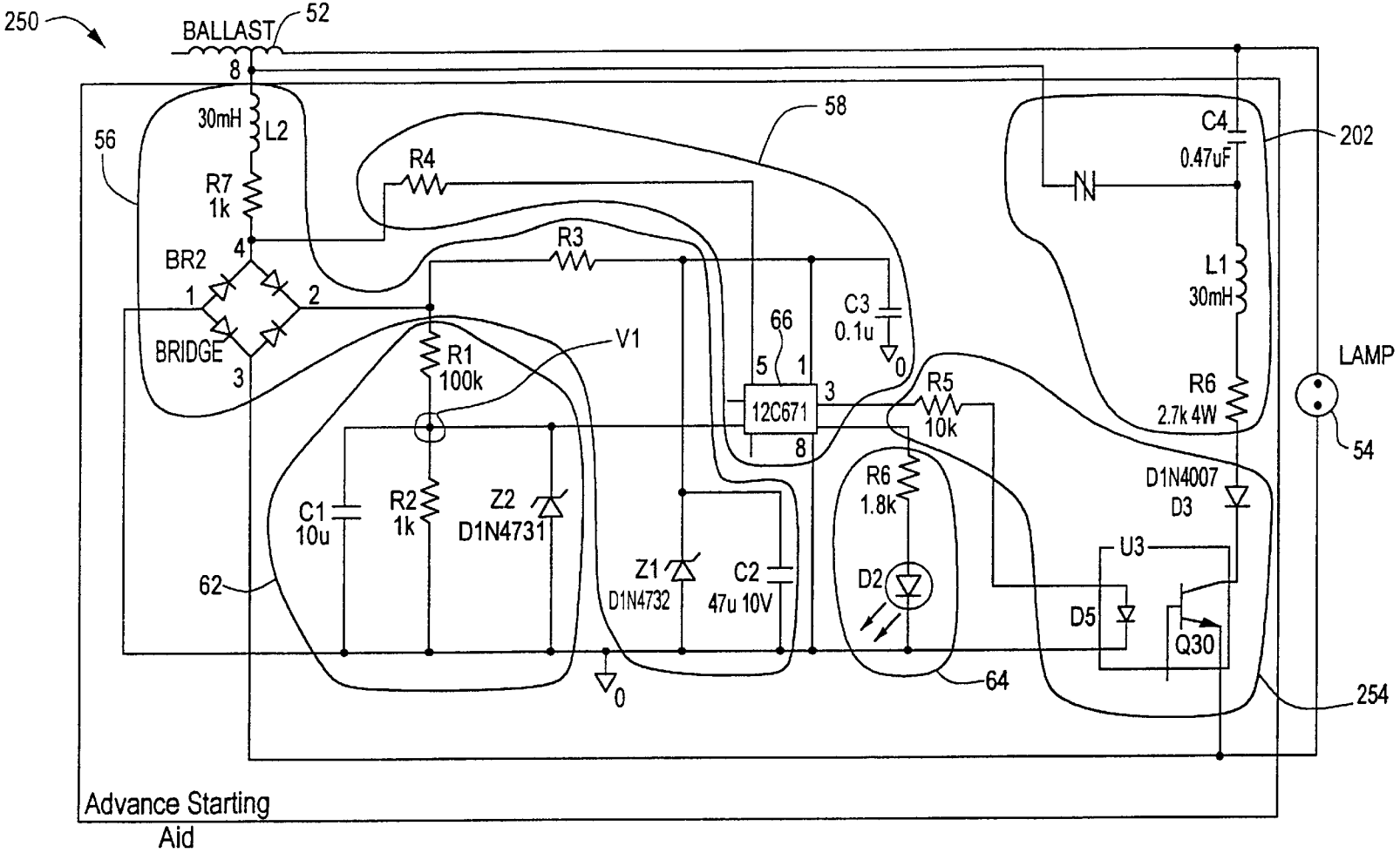
FIG. 7 is a schematic diagram of a fifth embodiment of the invention.

Another embodiment of the invention is shown at 250 in FIG. 7. Starting aid circuit 250 is identical to starting aid circuit 200, FIG. 6, except for the opto-coupler circuit 254, which includes a diode D5 and phototransistor Q30 for enabling SIDAC circuit 202.

Figure 8:
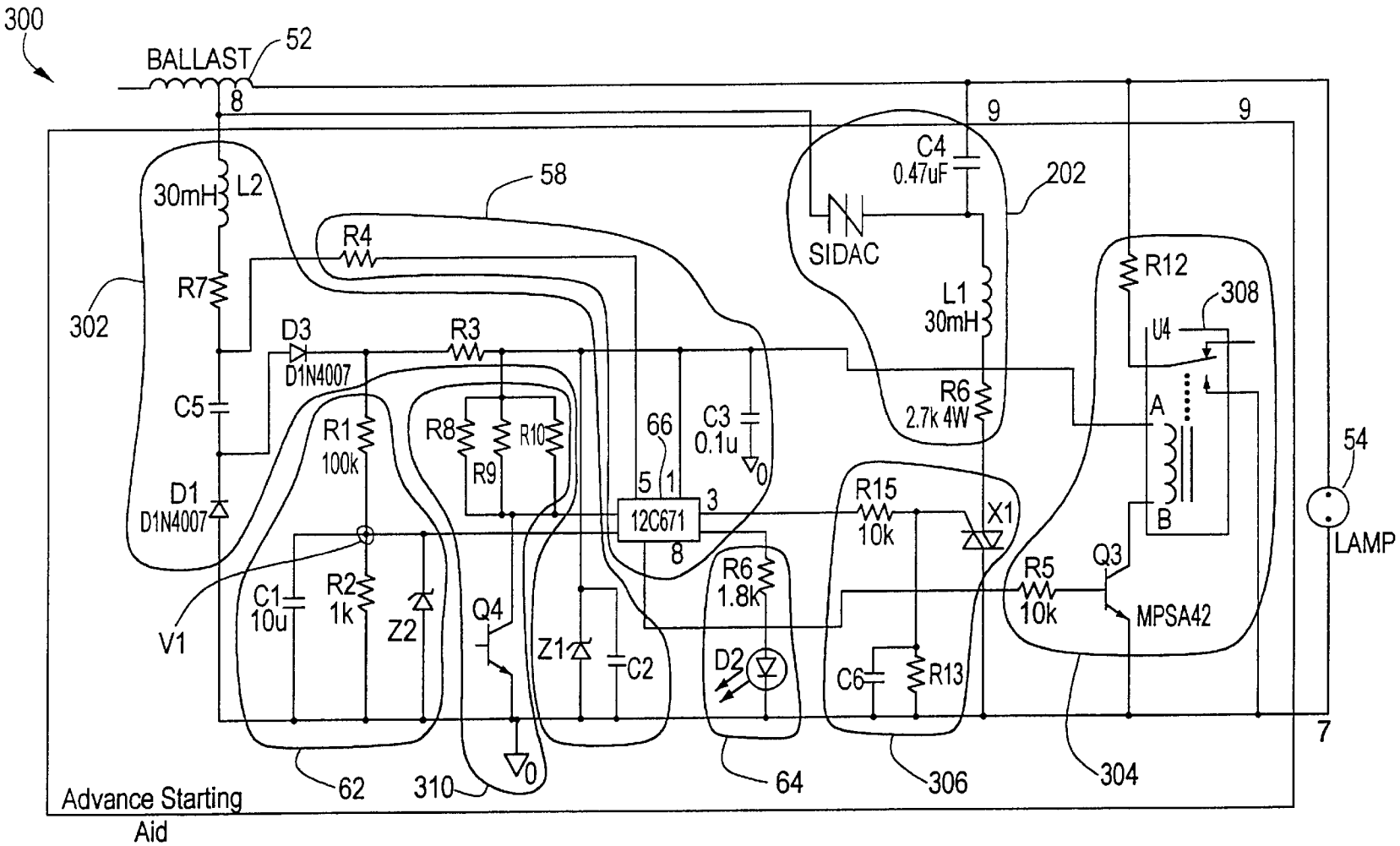
FIG. 8 is a schematic diagram of a sixth embodiment of the invention

Another embodiment of the invention is shown at 300 in FIG. 8. Starting aid circuit 300, includes power supply 302 which is a half wave power supply. Power supply 302, as compared to power supply 56, FIG. 7, provides half wave rectification. Resistor R7 and capacitor C5 serve to limit current while diode D3 serves as a blocking diode. Zener diode Z1, resistor R3 and capacitor C2 operate in the same manner as in power supply 56, FIG. 7. However, capacitor C2 has much larger capacitance in order to provide the same filtering.

Trigger circuit 306, includes resistors R15 and R13, capacitor C6, and TRIAC X1. Resistors R15 and R13 and capacitor C6 are pulse conditioning components. When TRIAC X1 receives a pulse at its gate, it will to enable SIDAC circuit 202. The advantage of starting aid circuit 300 is that because halfwave rectification is be used, opto-couplers or isolation transformers are no longer needed.

Lamp off circuit 304 includes relay 308, resistors R5 and R12, and transistor Q3. Resistor R5 and transistor Q3 drive relay 308 on and off in response to microprocessor 66, and relay 308 turns lamp 54 on and off. When relay 308 is energized, a short circuit is placed across lamp 54, extinguishing the lamp. This circuit also includes photo control circuit 30, similar to photocontrol circuit 102, FIG. 4. Cycling detection may also be included to determine if the lamp is cycling or off due to lighting conditions.

Figure 9:
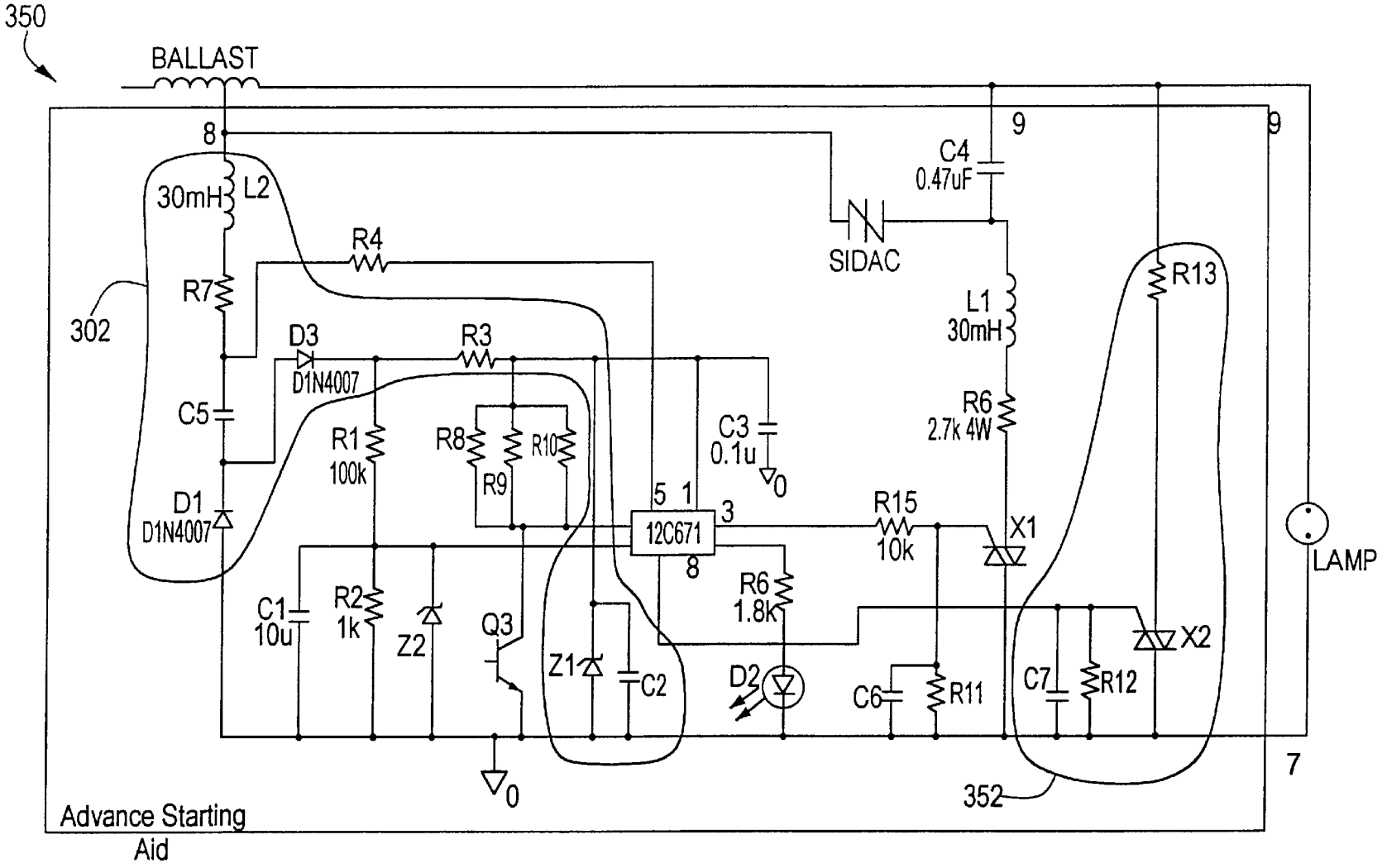
FIG. 9 is a schematic diagram of a seventh embodiment of the invention.

Another embodiment of the invention is shown at 350 in FIG. 9. Starting aid circuit 350 includes lamp off circuit 352 comprised of resistors R12, and 14, capacitor C7 and TRIAC X2. Because power supply 302 provides half wave rectification, no isolation transformer is required as shown in circuit 300 of FIG. 8.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

Other embodiments will occur to those skilled in the art and are within the following claims:

What is claimed is:

1. A starting aid circuit for a luminaire comprising:

a means for detecting a load drawn by or voltage across a lamp;

a microprocessor, responsive to the means for detecting, for controlling the start-up of the lamp and programmed to predict a condition of the lamp based on the load drawn or voltage across the lamp by comparing the voltage across the lamp with a tip voltage that is proportional to a line voltage;

a power supply for operating the microprocessor; and a trigger circuit, responsive to the microprocessor for turning on the lamp.

2. The starting aid of claim 1, wherein the detecting means comprises a voltage divider.

3. The starting aid circuit of claim 1 further including means, responsive to the microprocessor, for indicating the occurrence of the condition detected.

4. The starting aid circuit of claim 1 further including a photo controller for automatically turning the lamp on during periods of darkness and off during periods of daylight.

5. The starting aid circuit of claim 1 further including means, responsive to the microprocessor, for shunting the lamp to turn off the lamp.

6. The starting aid circuit of claim 1 in which the means for detecting includes a voltage divider.

7. The starting aid circuit of claim 1 in which the trigger circuit includes a SIDAC circuit for turning on the lamp.

8. The starting aid circuit of claim 7 in which the trigger circuit further includes a relay circuit, responsive to the microprocessor, for enabling the SIDAC circuit.

9. The starting aid circuit of claim 7 in which the trigger circuit further includes an opto-coupler, responsive to the microprocessor, for enabling the SIDAC circuit.

10. The starting aid circuit of claim 1 in which the power supply includes a full wave rectifier.

11. The starting aid circuit of claim 1 in which the power supply includes a half wave rectifier.

12. The starting aid circuit of claim 11 in which the trigger circuit includes a SIDAC circuit for enabling the lamp.

13. The starting aid circuit of claim 12 in which the trigger circuit further includes a TRIAC circuit, responsive to the microprocessor, for enabling the SIDAC circuit.

14. The starting aid circuit of claim 13 further including, means responsive to the microprocessor, for shunting the lamp to turn off the lamp.

15. The starting aid circuit of claim 14 in which the means for shunting includes a relay circuit, responsive to the microprocessor, for shorting the lamp.

16. The starting aid circuit of claim 14 in which the means for shunting includes a TRIAC circuit, responsive to the microprocessor, for shorting the lamp.

17. The starting aid circuit of claim 14 in which the means for shunting includes a SCR circuit, responsive to the microprocessor, for shorting the lamp.

18. The starting aid circuit of claim 3 in which the means for indicating includes a visual alarm.

19. The starting aid circuit of claim 3 in which the means for indicating includes an audible alarm.

20. The starting aid circuit of claim 3 in which the means for indicating includes a transmitter for transmitting the detected condition to a location.

21. The starting aid circuit of claim 3 in which the condition is a lamp dead condition.

22. The starting aid circuit of claim 3 in which the condition is a cycling condition.

23. The starting aid of claim 1, further comprising an indicator circuit.

24. An automatic starting aid for a lamp comprising:

a photocontroller for automatically turning the lamp on during periods of darkness and off during periods of daylight;

means for detecting a load drawn by or voltage across the lamp;

a microprocessor, responsive to the means for detecting and to the photocontroller, for controlling start-up of the lamp, wherein the microprocessor is programmed to detect a condition of the lamp in response to the load drawn or voltage across the lamp by comparing the voltage across the lamp with a trip voltage that is proportional to a line voltage of the lamp;

a power supply for operating the microprocessor; and a trigger circuit, responsive to the microprocessor, for turning on the lamp.

25. The automatic starting aid of claim 24 further including means, responsive to the microprocessor, for shunting the lamp to turn off the lamp.

26. The automatic starting aid of claim 25, further including means, responsive to the microprocessor, for indicating the occurrence of the condition detected.

27. A starting aid comprising:

a trigger circuit for supplying a tigger voltage pulse to a lamp in response to the presence of a line voltage signal supplied by a photodetector;

a feedback circuit for detecting the lamp voltage; and means, responsive to the line voltage signal and the feedback circuit, for comparing the voltage on the lamp to a nominal voltage level for disabling the trigger circuit and terminating the trigger voltage pulse in the presence of a lamp cycling or lamp out condition, wherein the nominal voltage is proportional to the line voltage of the lamp, such that the starting aid may be used with lamps of varying voltage.

28. The starting aid of claim 27 in which the means for comparing includes a processor programmed to determine when the lamp voltage switches between a nominal voltage level and a non-nominal voltage level N times indicative of a lamp cycling condition.

29. The starting aid of claim 28 in which N is 5.

30. The starting aid of claim 27 in which the means for comparing includes a processor programmed to determine when the voltage on the lamp fails to reach a nominal voltage level after M trigger voltage pulses.

31. The starting aid of claim 30 in which M is 2.

32. The starting aid of claim 27 further including means, responsive to the line voltage signal, for supplying to the trigger circuit a series of trigger pulses at predetermined portions of the line voltage signal.

33. The starting aid of claim 32 wherein the means for supplying includes a microprocessor programmed to determine a zero crossing point of the line voltage signal and to output the series of pulses when the line voltage signal reaches 90° and 270°.

34. The starting aid of claim 33 wherein the trigger circuit includes a transformer which is activated by the series of trigger pulses and in response produces a lamp starting voltage to the lamp.

35. The starting aid of claim 1, wherein the trip voltage is 0.75 times the line voltage so that the starting aid can be used in conjunction with a 55 volt lamp or a 100 volt lamp without modification.

36. The starting aid of claim 1, wherein the detecting means comprises a rectifier that rectifies the load voltage to create a sample voltage.

37. The starting aid of claim 1, wherein the trigger circuit comprises:

a transistor that is driven on and off by the pulse train and produces an output voltage of approximately 5 volts;

a transformer connected to the output of the transistor that steps up the output voltage of the transistor to approximately 3500 volts.

38. The starting aid of claim 37, wherein each pulse of the pulse train lasts for 1.5 microseconds.

39. The starting aid of claim 27, wherein the nominal voltage is 0.75 times the line voltage so that the starting aid can be used in conjunction with a 55 volt lamp or a 100 volt lamp without modification.

40. A diagnostic starting aid for a luminaire comprising:

means for detecting a load drawn by or voltage across a lamp;

a microprocessor, responsive to the means for detecting a load drawn or voltage across the lamp, the microprocessor programmed to detect a condition of the luminaire in response to the load drawn by comparing the voltage across the lamp with a trip voltage that is proportional to a line voltage of the lamp, such that the starting aid may be used for lamps of varying power;

a photocontroller for controlling the start-up of the lamp;

a power supply for operating the microprocessor;

a trigger circuit, responsive to the microprocessor, for turning on the lamp; and means, response to the microprocessor, for indicating the occurrence of the condition detected.

41. The starting aid of claim 40, wherein the trigger circuit comprises:

a transistor that is driven on and off by the pulse train and produces an output voltage of approximately 5 volts;

a transformer connected to the output of the transistor that steps up the output voltage of the transistor to approximately 3500 volts.

42. The starting aid of claim 40, wherein the trigger voltage is 0.75 times the line voltage so that the starting aid can be used in conjunction with a 55 volt lamp or a 100 volt lamp without modification.

43. The automatic aid of claim 24, wherein the trigger voltage is 0.75 times the line voltage so that the starting aid can be used in conjunction with a 55 volt lamp or a 100 volt lamp without modification.

44. The starting aid of claim 27, wherein the nominal voltage is 0.75 times the line voltage so that the starting aid can be used in conjunction with a 55 volt lamp or a 100 volt lamp without modification.

45. A starting aid circuit for a luminaire, comprising:

a voltage divider circuit to detect a voltage across a lamp;

a microprocessor, responsive to an input from the voltage detection device, for controlling the start-up of the lamp and programmed to predict a condition of the lamp based on the voltage across the lamp by comprising the voltage across the lamp with a trip voltage that is proportional to a line voltage;

a trigger circuit, responsive to the microprocessor for turning on the lamp;

a communications device for transmitting a signal to a power supply for operating the voltage detection circuit, the microprocessor the trigger circuit and the communications device.

46. The starting aid of claim 45, wherein the trigger circuit comprises:

a transistor that is driven on and off by the pulse train and produces an output voltage of approximately 5 volts;

a transformer connected to the output of the transistor that steps up the output voltage of the transistor to approximately 3500 volts.

47. The starting aid circuit of claim 45 further comprising a shunting circuit to off the lamp in response to receiving a signal from the microprocessor.

* * * * *